US007081857B2

(12) United States Patent
Kinnunen et al.

(10) Patent No.: US 7,081,857 B2
(45) Date of Patent: Jul. 25, 2006

(54) ARRANGEMENT FOR CONNECTING ADDITIONAL ANTENNA TO RADIO DEVICE

(75) Inventors: Pekka Kinnunen, Oulu (FI); Jyrki Mikkola, Kaustinen (FI)

(73) Assignee: LK Products Oy, Kempele (FI)

( * ) Notice: Subject to any disclaimer, the term of this patent is extended or adjusted under 35 U.S.C. 154(b) by 0 days.

(21) Appl. No.: 11/136,598

(22) Filed: May 23, 2005

(65) Prior Publication Data

US 2005/0237247 A1 Oct. 27, 2005

Related U.S. Application Data

(63) Continuation of application No. PCT/FI2003/000892, filed on Nov. 20, 2003.

(30) Foreign Application Priority Data

Dec. 2, 2002 (FI) ..... 20022117

(51) Int. Cl.
*H01Q 1/24* (2006.01)

(52) U.S. Cl. ..... 343/702

(58) Field of Classification Search ..... 343/702
See application file for complete search history.

(56) References Cited

U.S. PATENT DOCUMENTS

| | | | | |
|---|---|---|---|---|
| 6,031,492 | A | 2/2000 | Griffin et al. | |
| 6,157,819 | A | 12/2000 | Vuokko et al. | |
| 6,225,951 | B1 * | 5/2001 | Holshouser et al. | 343/700 MS |
| 6,239,769 | B1 | 5/2001 | Ericsson et al. | |
| 6,317,089 | B1 | 11/2001 | Wilson et al. | |
| 6,342,860 | B1 * | 1/2002 | Haussler et al. | 343/702 |
| 6,507,322 | B1 * | 1/2003 | Fang et al. | 343/770 |
| 6,759,989 | B1 * | 7/2004 | Tarvas et al. | 343/700 MS |
| 2002/0154066 | A1 | 10/2002 | Bama et al. | |
| 2006/0017626 | A1 * | 1/2006 | Kannan et al. | 343/702 |

FOREIGN PATENT DOCUMENTS

| | | |
|---|---|---|
| EP | 0 999 607 A2 | 5/2000 |
| EP | 1 006 606 A1 | 6/2000 |
| EP | 1 170 822 A1 | 1/2002 |
| FI | 100 927 B | 11/1997 |
| GB | 2 266 997 A | 11/1993 |

* cited by examiner

*Primary Examiner*—Tho Phan
(74) *Attorney, Agent, or Firm*—Darby & Darby

(57) ABSTRACT

An arrangement for connecting an additional antenna to a portable radio device (RD) having an internal planar antenna. Energy for the additional antenna is taken from the near field of the planar antenna, the coupling elements being provided by conductors (311, 312) located outside the covering of the radio device and following the conductive branches (B1, B2) of the radiating plane (RPL) of the planar antenna. The arrangement further comprises a conductive plate (320) located in front of and parallel to the ground plane (GND) in the radio device to take energy from the field of the ground plane. The inner conductor of the cable (330) for the additional antenna is galvanically connected to the conductors placed over the planar antenna, and the sheath is galvanically connected to the conductive plate (320) near the connection point of the inner conductor.

9 Claims, 3 Drawing Sheets

ARRANGEMENT FOR CONNECTING ADDITIONAL ANTENNA TO RADIO DEVICE

CROSS REFERENCE TO PRIOR APPLICATION

This application is a continuation of International Patent Application Serial No. PCT/FI2003/000892, filed Nov. 20, 2003, which claims priority of Finnish Application No. 20022117, filed Dec. 2, 2002, both of which are incorporated by reference herein. PCT/FI2003/000892 published in English on Jun. 17, 2004 as WO 2004/051799 A1.

The invention relates to an arrangement for connecting an additional antenna to a portable radio device, especially a mobile station, to enhance radiocommunications.

BACKGROUND OF THE INVENTION

In practice, an additional antenna for a mobile phone or some other mobile communication device is most often used in a vehicle as the base station's field strength is low within the body of the vehicle. The additional antenna is in that case naturally situated outside the body of the vehicle, attached thereto. For using an external antenna the vehicle may include a fixed holder so that a phone placed in the holder will be connected to the external antenna through a cable. A holder designed mainly for hands-free operation may also include connection means for an external antenna.

For the purpose of connecting an additional antenna a mobile station may include a coaxial connector in conjunction with the antenna port. Such a connector arrangement based on galvanic contact is, however, relatively expensive and unreliable in the long term. Instead of galvanic contact, electromagnetic coupling can be applied. From patent document GB 2,266,997 is known a solution according to FIG. 1. Therein, a coupling part 110 is attached to the covering of a radio device RD with velcro tape or the like for vehicular use, with a coaxial cable 130 running from said coupling part to an additional antenna, i.e. the external antenna of a car in the case illustrated in that particular patent document. Inside the coupling part 110 there is a conductive loop shaped such that there is a notable inductive coupling between the internal antenna ANT of the radio device and the conductive loop. Radio frequency energy is transferred via the inductive coupling to the external antenna during transmitting and from the external antenna into the radio device during receiving. A disadvantage of this solution is that the attachment of the coupling part may significantly shift the operating band of the antenna and degrade the matching of the antenna at least in part of the operating band. Moreover, the strength of the coupling leaves somewhat to be desired. This is emphasized by the fact that transmitting energy in the field of the conductive frame of the radio device is not transferred to the external antenna via the coupling.

From patent document Fl 100927 is known an arrangement according to FIG. 2 for connecting an additional antenna. In the figure there is a radio device RD with an external antenna ANT. The radio device is placed in a holder 250 extended by a coupling element 210 according to the patent in question. The coupling element is formed of a dielectric block the longitudinal opposing surfaces of which are coated with a conductive material. The outer of these coatings is connected to the outer conductor 232 of a coaxial cable belonging to the arrangement, and the other coating is connected to the inner conductor 231 of the coaxial cable. The coupling element 210 partly surrounds the antenna ANT and is positioned at such an angle with respect to the longitudinal axis thereof that the radio frequency field of the antenna ANT is mainly guided to the coupling element via an intermediate coupling hole 215 and the end surface of the coupling element. From the coupling element the field further is guided via said coaxial cable to the additional antenna. The outer surface of the holder 250 is coated with a planar conductive material 220 in galvanic contact with the outer coating of the connecting element 210 and the outer conductor 232 of the cable. The conductive plane 220 has a significant electromagnetic coupling with the conductive frame of the radio device so that transmitting energy in the field of the frame is transferred to the additional antenna.

A drawback of the connection arrangement of FIG. 2 is that it cannot be applied to a radio device having an internal antenna.

SUMMARY OF THE INVENTION

An object of the invention is to reduce the aforementioned disadvantages associated with the prior art. The connection arrangement according to the invention is characterized in that which is specified in the independent claim 1. Some preferred embodiments of the invention are specified in the other claims.

The basic idea of the invention is as follows: Electromagnetic coupling for an additional antenna is provided in a radio device having an internal planar antenna. Energy for the additional antenna is taken from the near field of the planar antenna, the coupling elements being provided by conductors located outside the covering of the radio device and following the conductive branches of the radiating plane of the planar antenna. The coupling device for the additional antenna further comprises a conductive plate which is located in front of and parallel to a conductive plane serving as a ground plane in the radio device. The inner conductor of the cable for the additional antenna is galvanically connected to the conductors placed over the planar antenna, and the sheath is galvanically connected to the conductive plate near the connection point of the inner conductor. The coupling device constitutes a fixed entity mechanically adapted for the radio device and is to be placed on the radio device, or the radio device is placed in said entity.

An advantage of the invention is that the coupling is relatively efficient: transmitting energy for the additional antenna is gathered both from the field of the inner planar antenna and from the field corresponding to the radio frequency currents flowing in the ground plane of the radio device. Another advantage of the invention is that the effect of the introduction of an additional antenna on the location of the operating band is small in spite of the efficiency of the coupling. A further advantage of the invention is that the arrangement according to it is reliable and involves relatively small costs.

BRIEF DESCRIPTION OF THE DRAWINGS

The invention will now be described in detail. Reference is made to the accompanying drawings where.

DETAILED DESCRIPTION OF THE INVENTION

Figure 1:
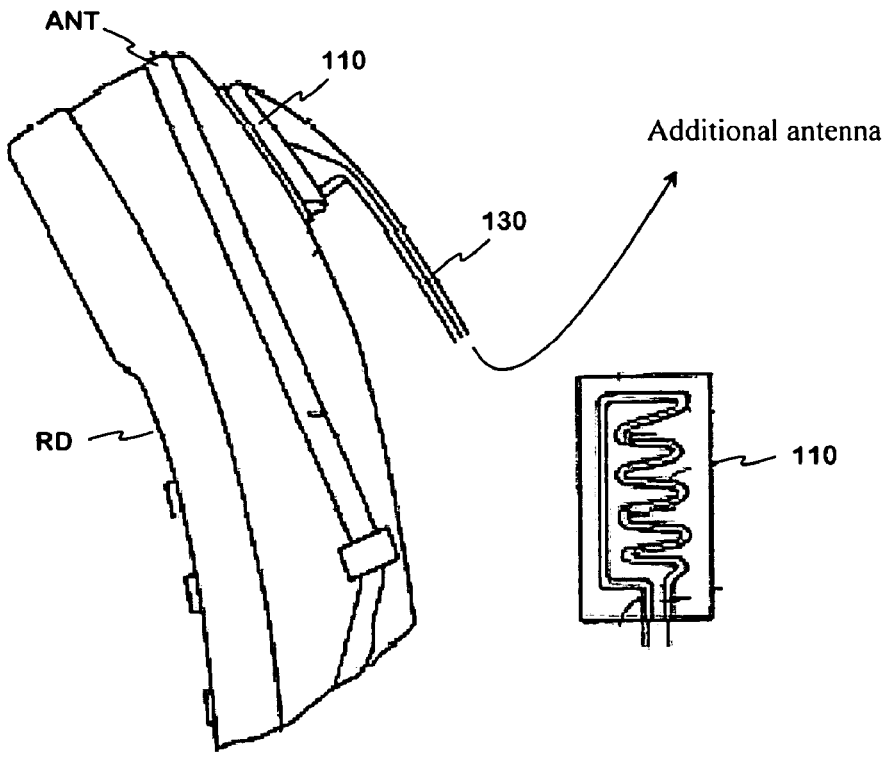
Fig. 1 PRIOR ART
FIG. 1 shows an example of an arrangement according to the prior art for connecting an additional antenna.
Figure 2:
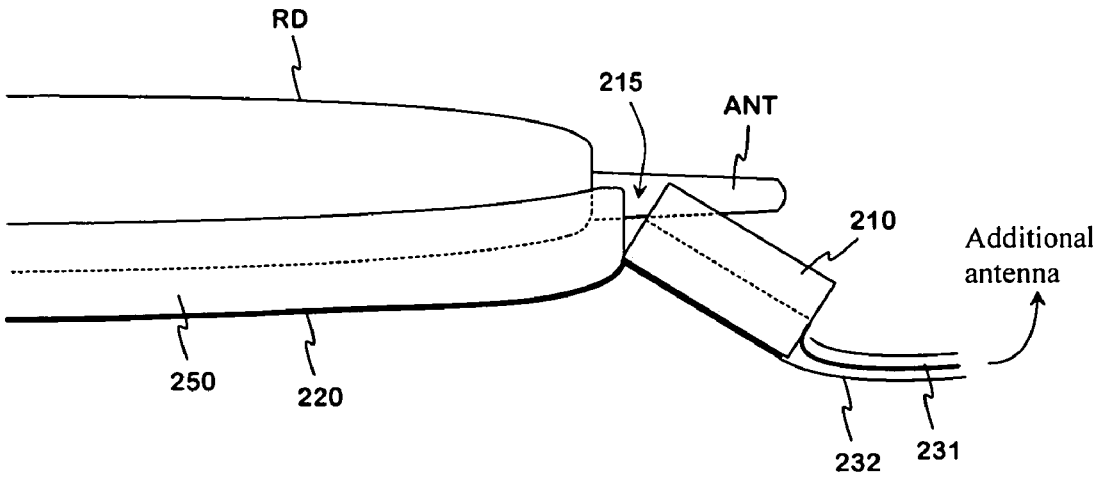
Fig. 2 PRIOR ART
FIG. 2 shows a second example of an arrangement according to the prior art for connecting an additional antenna.

FIGS. 1 and 2 were already discussed in conjunction with the description of the prior art.

Figure 3:
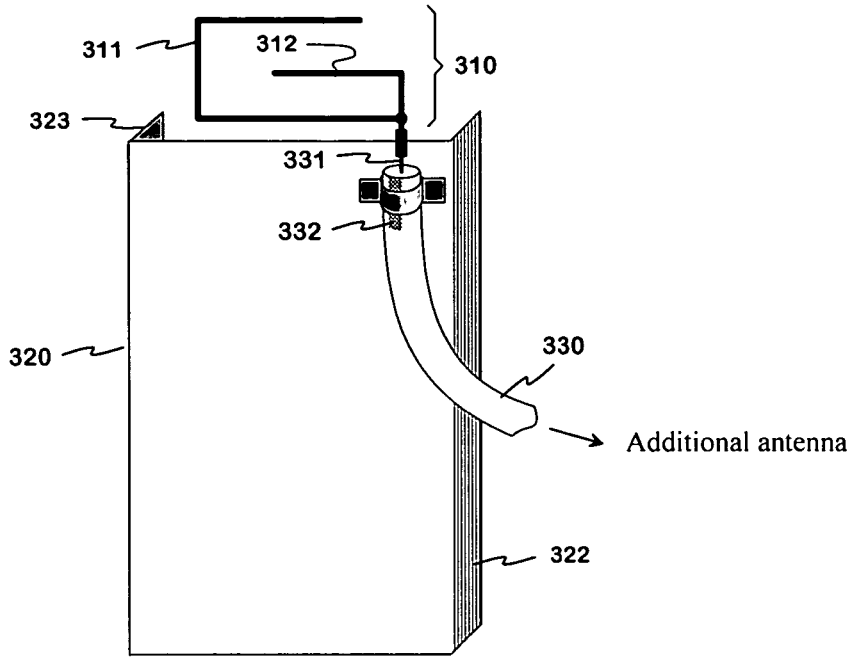
FIG. 3 shows an example of a coupling device according to the invention, FIGS. 4*a,b* show the coupling device of FIG. 3 in use, FIGS. 5*a,b* show a second example of a coupling device according to the invention.

FIG. 3 shows an example of a device according to the invention for connecting an additional antenna. The device comprises a first coupling part 310, second coupling part 320, and an intermediate cable 330. The first coupling part is intended to be placed over the planar antenna of the radio device and it comprises two coupling conductors 311 and 312 which in this example are rigid conductive wires. These are interconnected such that they have, viewed from below in figure, a short common part followed by two branches. The second coupling part 320 is intended to be placed over the ground plane of the radio device and comprises a conductive plate the side fringes of which are bent at a right angle so as to form folds 322, 323. Viewed along the normal of the conductive plate 320, the coupling parts are adjacent so that the first coupling part is located close to the upper edge of the conductive plate. The first coupling part is supported on the conductive plate by means of dielectric material in such a manner that their mutual position cannot change. The supporting element is not shown in FIG. 3. The intermediate cable 330 is coaxial and fastened at one end to the conductive plate 320. The inner conductor 331 of the intermediate cable is in galvanic contact with the conductive wires 311, 312 at their common lower end, and the outer conductor 332 of the intermediate cable is in galvanic contact with the conductive plate 320 near the upper edge thereof and near the connection point of the inner conductor. Fastening of the intermediate cable and the connection of its outer conductor can be realized e.g. with one and the same conductive crimp joint.

Here and in the claims, the phrase "near" something refers to a distance which is at least one order of magnitude shorter than the wavelength of oscillation occurring in the structure. Words "lower" and "upper" refer to the positions of devices as depicted in FIGS. 3 to 6, and they have nothing to do with the operating positions of the devices.

Figure 4A:
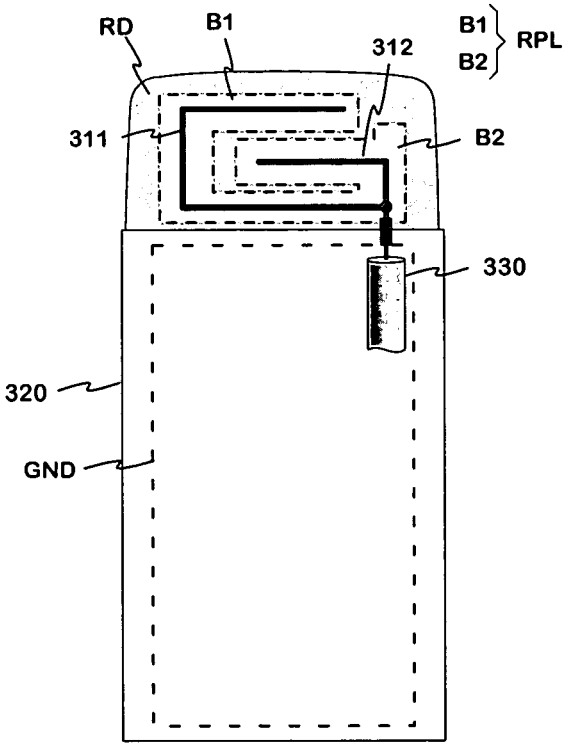
Figure 4B:
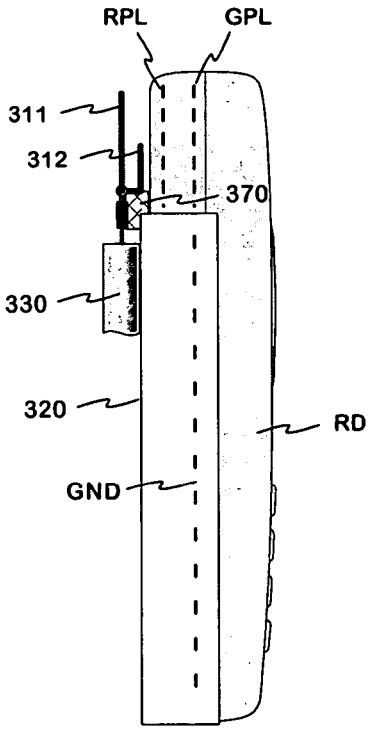

FIGS. 4*a* and 4*b* show an arrangement according to the invention with the coupling device of FIG. 3 installed on its target device. The target device is a radio device RD, in this example a mobile phone. FIG. 4*a* shows the combination viewed from behind of the mobile phone and FIG. 4*b* from aside of the mobile phone. The phone RD has an internal planar antenna including a radiating plane RPL and antenna ground plane GPL. The radiating plane is in this example divided into two branches in order to increase the number of operating bands. The first branch B1 is formed of the edge areas of the radiating plane excluding one end, while the second, shorter, branch B2 is mainly formed of the center region of the plane. The feed and short-circuit points of the antenna are in a region where the branches B1, B2 meet. The phone RD further has a large ground plane GND which usually is a part of the same conductive plane as the antenna ground plane GPL.

The coupling device for an additional antenna is placed on the back side of the mobile phone (or the mobile phone is placed to the coupling device by its back side). The first coupling part 310 faces the internal planar antenna in such a manner that the first conductive wire 311 follows the first branch B1 of the radiating plane of the internal antenna. This means that, viewed along the normal of the radiating plane RPL, the conductive wire 311 is located over the branch B1 for most of the length of the branch B1. Similarly, the second conductive wire 312 follows the second branch B2 of the radiating plane. The conductive wire is located in the reactive near field of the planar antenna part corresponding to the branch in question when it resonates. Through such electromagnetic coupling, energy fed by the radio device to the planar antenna can be transferred to a load, in this case an additional antenna, connected to the conductive wires 311, 312. Naturally, the system operates also in reverse, so that energy received by the additional antenna via air is transferred to the field of the internal planar antenna and, from there, to the receiver in the radio device. Accordingly, the phrase used in the claims, "to take energy from the near field of the internal antenna", refers to reverse operation as well, in which energy is transferred from the additional antenna to the field of the internal antenna.

The conductive plate 320, which constitutes the second coupling part, is placed on the phone covering over the ground plane GND of the radio device, galvanically isolated therefrom. FIGS. 4*a* and 4*b* further show that the bent portions of the conductive plate 320 are located against the sides of the phone. This way the phone is held in place, at the same time increasing the electromagnetic coupling between the conductive plate and ground plane. Through this coupling, energy of the radio frequency field of the ground plane is transferred to the additional antenna, improving the efficiency of the coupling device. The conductive plate 320 and conductive wires 311, 312 function as a generator feeding the additional antenna through the intermediate cable 330. When the current in the conductive wires flows towards the inner conductor of the intermediate cable, the conductive plate receives current from the outer conductor of the intermediate cable, and vice versa.

FIG. 4*b* shows that the second conductive wire 312 travels closer to the mobile phone covering and radiating plane than the first conductive wire 311. By such a design of conductive wires in the direction of depth and also in a plane parallel to the radiating plane it is possible to tune the strengths of electromagnetic couplings as desired. FIG. 4*b* further shows an exemplary dielectric block 370 supporting the conductive wires on the conductive plate 320.

Figure 5A:
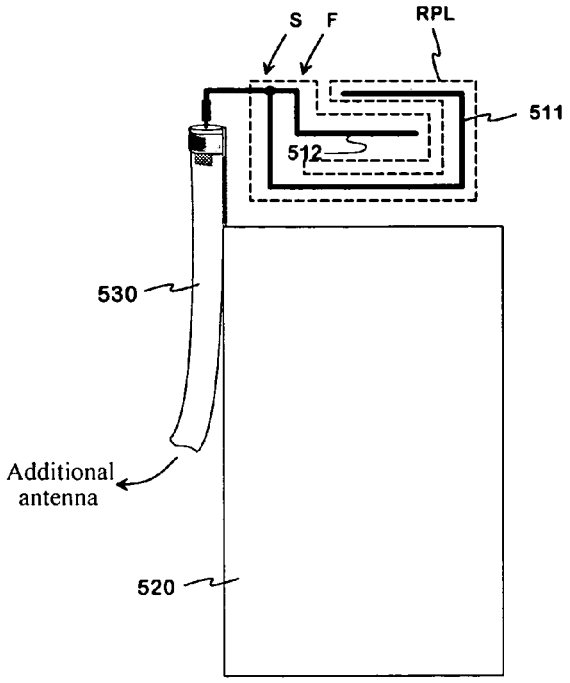
Figure 5B:
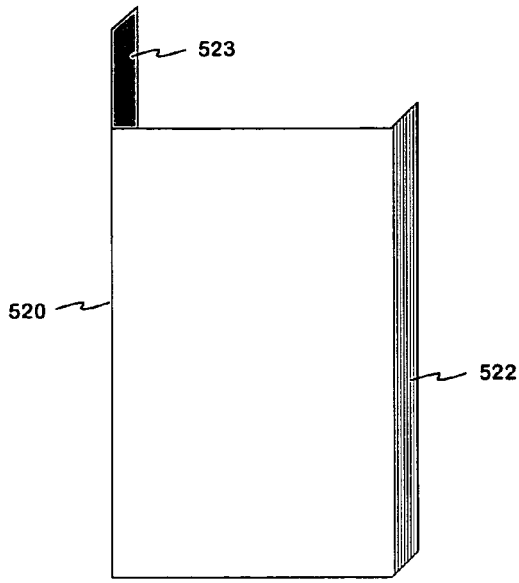

FIGS. 5*a* and 5*b* show a second example of a coupling device according to the invention for an additional antenna. The coupling device is intended for a radio device in which the feed and short-circuit of an internal planar antenna take place at the upper edge of the antenna. This is illustrated in FIG. 5*a* where arrows indicate the locations of the feed point F and short-circuit point S in the radiating plane RPL of the antenna, marked out in dashed line. The coupling device is in principle similar to that shown in FIGS. 3 and 4*a,b*. It comprises conductive wires 511 and 512 which follow the branches of the radiating plane and meet near the antenna feed area. The conductive wires are in galvanic contact with the center conductor of the intermediate cable 530 for the additional antenna. For electromagnetic coupling with the ground plane of the radio device, there is a conductive plate 520 similar to that shown in FIG. 3. Now, however, one of the folds 523 is longer, extending close to that upper corner of the antenna at which the feed and short-circuit points are located. The outer conductor of the intermediate cable is galvanically connected to the conductive plate 520 at an end of said fold 523, whereby this connection of the outer conductor, equivalent to grounding, takes place near the connection point of the inner conductor and the ground of the antenna port in the radio device when the radio device is in place.

Figure 6:
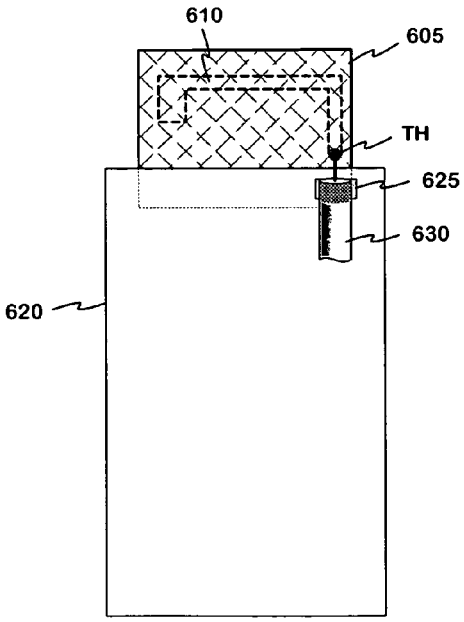
FIG. 6 shows a third example of a coupling device according to the invention.

FIG. 6 shows a third example of a coupling device according to the invention for an additional antenna. This coupling device is intended for single-band radio devices, therefore it only has one coupling conductor 610 placed over the radiating plane of the antenna. The coupling conductor is in this example a conductive strip on the surface of a small dielectric plate 605. The dielectric plate is fastened to a conductive plate 620 similar to the conductive plate 320 in FIG. 3. The inner conductor of the intermediate cable 630 for the additional antenna is soldered onto a through hole TH in the dielectric plate, through which a galvanic contact is made with the conductive strip 610 being on the surface face to face with the internal antenna. The outer conductor of the intermediate cable is in this example soldered onto the conductive plate 620 using paste 625.

Figure 7:
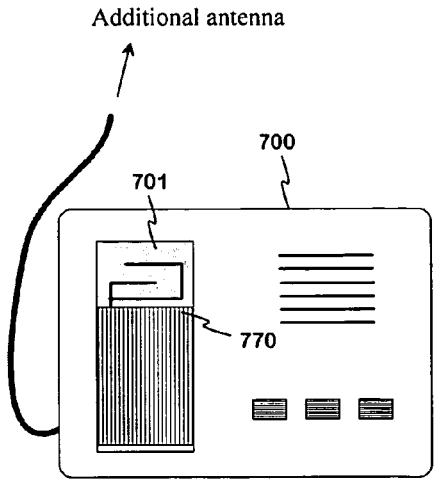
FIG. 7 shows an example of placing a coupling device according to the invention in a hands-free apparatus.

FIG. 7 shows an example of combining a coupling device according to the invention as a mechanical structure with a hands-free apparatus. An apparatus 700 intended primarily for hands-free operation includes a hollow 701. Onto the hollow there is attached a coupling device 770 according to the invention, into which a user's radio device is to be inserted. A intermediate cable runs from the coupling device to an additional antenna. At the lower edge of the hollow there naturally is a connector (not shown) for galvanically connecting the radio device with the hands-free circuits.

Coupling arrangements according to the invention for an additional antenna were described above. The designs and implementations of the components of the coupling device may naturally differ from those described. Just mechanical and electrical adaptation for different radio devices alone results in variation in the elements of the device. The inventional idea can be applied in different ways within the scope defined by the independent claim 1.

The invention claimed is:

1. An arrangement for connecting an additional antenna to a radio device which has a ground plane and an internal planar antenna with a radiating plane, which arrangement comprises a first coupling part for providing coupling with the internal antenna, a second coupling part for providing coupling with the ground plane and an intermediate cable for the additional antenna, the second coupling part comprising a conductive plate galvanically isolated from the radio device, which plate, when the arrangement is in use, is substantially parallel to the ground plane of the radio device and in front thereof in the direction of the normal of the ground plane in order to take energy from the radio frequency field of the ground plane, wherein the first coupling part comprises at least one coupling conductor galvanically isolated from the radio device, which conductor, when the arrangement is in use, follows a conductive branch of the radiating plane of the internal antenna being located over said conductive branch for most of the length thereof, to take energy from the near field of the internal antenna, and a first conductor of the intermediate cable is in galvanic contact with said coupling conductor, and a second conductor of the intermediate cable is in galvanic contact with said conductive plate near the connection point of the first conductor.

2. An arrangement according to claim 1, the number of said coupling conductors being two, which coupling conductors, when the arrangement is in use, follow the different conductive branches of the radiating plane of the internal antenna and which are galvanically interconnected near the connection point of the first conductor of the intermediate cable.

3. An arrangement according to claim 2, said coupling conductors being rigid conductive wires and having a first point and a second point such that when the arrangement is in use, the distances of the first and second points from the radiating plane are substantially different.

4. An arrangement according to claim 1, said at least one coupling conductor being a rigid conductive wire.

5. An arrangement according to claim 1, said at least one coupling conductor being a conductive strip on a surface of a dielectric plate.

6. An arrangement according to claim 1, said conductive plate comprising bent portions which are arranged to face the side surfaces of the radio device.

7. An arrangement according to claim 1, the intermediate cable being coaxial whereby the first conductor thereof is an inner conductor and the second conductor is an outer conductor.

8. An arrangement according to claim 7, the outer conductor of the intermediate cable being connected to said conductive plate by a conductive crimp joint.

9. An arrangement according to claim 1, being mechanically a part in a device fabricated primarily for hands-free operation, in which a radio device is to be inserted.

* * * * *